US007121690B1

(12) United States Patent
Ramer et al.

(10) Patent No.: US 7,121,690 B1
(45) Date of Patent: Oct. 17, 2006

(54) CONSTRUCTIVE OCCLUSION WITH A TRANSMISSIVE COMPONENT

(75) Inventors: David P. Ramer, Reston, VA (US); Jack C. Rains, Herndon, VA (US); Matthew Brown, Falls Church, VA (US)

(73) Assignee: Advanced Optical Technologies, LLC, Herndon, VA (US)

( * ) Notice: Subject to any disclaimer, the term of this patent is extended or adjusted under 35 U.S.C. 154(b) by 85 days.

(21) Appl. No.: 10/786,096

(22) Filed: Feb. 26, 2004

(51) Int. Cl.
*F21V 7/00* (2006.01)

(52) U.S. Cl. ..... 362/297; 362/147; 362/217; 362/325; 362/404

(58) Field of Classification Search ..... 362/297, 362/147, 217, 223, 224, 325, 328, 327, 342, 362/346, 347, 404
See application file for complete search history.

(56) References Cited

U.S. PATENT DOCUMENTS 3,677,643 A * 7/1972 Sagawa ..... 355/91
3,797,934 A * 3/1974 Miller et al. ..... 355/52
4,112,483 A 9/1978 Small, Jr. et al.
4,388,675 A 6/1983 Lewin
4,937,716 A 6/1990 Whitehead
5,282,117 A 1/1994 Fritts
5,384,658 A 1/1995 Ohtake et al.
5,705,804 A 1/1998 Ramer et al.
5,733,028 A 3/1998 Ramer et al.
5,773,819 A 6/1998 Ramer et al.
5,839,823 A 11/1998 Hou et al.
5,877,490 A 3/1999 Ramer et al.
5,877,849 A 3/1999 Ramer et al.
5,886,351 A 3/1999 Ramer et al.
5,914,487 A 6/1999 Ramer et al.
5,967,652 A * 10/1999 Ramer et al. ..... 362/552
6,007,225 A 12/1999 Ramer et al.
6,043,873 A 3/2000 Ramer et al.
6,064,061 A 5/2000 Ramer et al.
6,088,091 A 7/2000 Ramer et al.
6,231,208 B1 5/2001 Dalton et al.
6,238,077 B1 5/2001 Ramer et al.
6,266,136 B1 7/2001 Ramer et al.
6,280,052 B1 8/2001 White (Continued)

FOREIGN PATENT DOCUMENTS

JP 2000-214311 8/2000

(Continued)

OTHER PUBLICATIONS

"Finelite Introduces" Series 14.

(Continued)

*Primary Examiner*—John Anthony Ward
*Assistant Examiner*—Mark Tsidulko
(74) *Attorney, Agent, or Firm*—McDermott Will & Emery LLP

(57) ABSTRACT

Constructive occlusion type lighting systems utilize a reflective mask to cover a portion of an active optical surface, typically a Lambertian surface formed by the aperture of a diffusely reflective cavity, in order to distribute radiant energy with a tailored intensity distribution. Adjustment of the parameters of the constructive occlusion system enables the system designer to tailor the system performance to a wide range of applications. As disclosed herein, the constructive occlusion type distribution is combined with a diffuse distribution of a transmissive component, emitted through a wall of the system. For example, a diffusely reflective wall of the cavity may also be partially transmissive, to allow some energy to pass through and provide an additional illumination component, while continuing to maintain the characteristics to support the constructive occlusion component.

20 Claims, 7 Drawing Sheets

U.S. PATENT DOCUMENTS

| | | | | |
|---|---|---|---|---|
| 6,286,979 | B1 * | 9/2001 | Ramer et al. | 362/297 |
| 6,334,700 | B1 | 1/2002 | Ramer et al. | |
| 6,342,695 | B1 | 1/2002 | Ramer et al. | |
| 6,361,190 | B1 * | 3/2002 | McDermott | 362/310 |
| 6,364,505 | B1 | 4/2002 | Shoenfeld | |
| 6,416,201 | B1 | 7/2002 | Strand et al. | |
| 6,644,830 | B1 | 11/2003 | Lewis et al. | |
| 6,700,112 | B1 | 3/2004 | Brown | |
| 2004/0252521 | A1 | 12/2004 | Clark et al. | |

FOREIGN PATENT DOCUMENTS

| | | |
|---|---|---|
| JP | 2003-223805 | 8/2003 |
| KR | 2004021274 | * 10/2004 |

OTHER PUBLICATIONS

"Series 14 Specifications", Series 14 Order Specification, p. 1-2, http://www.finelite.com/prodinfo/s14/s14specs.htm, Jul. 23, 2004.

"Series 14 Wall Mount Specifications" Series 14 Wall Mount Order Specification, p. 1-2, http://www.finelite.com/prodinfo/s14/s14WMspecs.htm, Jul. 23, 2004.

"Introduction Series 14" Series 14 Product Introduction, p. 1-2, for immediate release union city, CA, May 30, 2003.

"14 Wall Mount Product Information Series", Series 14 Product Information, p. 1-4.

"FINELITE", Read the Label, Finelite, Inc., 30300 Whipple Road, Union City, CA 94587-1525.

"FINELITE, Better Lighting for a Better Workplace", Series 14.

"FINELITE, Better Lighting for a Better Workplace", Series 14, White Cross Blade, Round Perf Concave Shield, Square Perf Concave Shield.

"FINELITE", Series 14 WCF—T5HO Photometric Reports.

"FINELITE", Series 14—Technical Sheet.

"FINELITE", Series 14 Wall Mount—Technical Sheet.

"Finelite Introduces Series 15".

Introducing Series 15, For Immediate Release, Union City, CA, Nov. 3, 2003.

"Series 15 Product Information", Product Features, p. 1-4.

"Introducing Series 15", Union City, CA—Nov. 3, 20003, p. 1-2, Nov. 10, 2003.

"APPGUIDE, Finelite Series 15—T8/T5-HO", Lighting Application Guide.

"Finelite, Better Lighting for a Better Workplace", Series 15.

"Series 15 Specifications" Series 15 Order Apecifications p. 1-2, Dec. 16, 2003.

FINELITE, Series 15—Technical Sheet.

"IESNA:LM-63-1995" (Test) 18033.

"IESNA:LM-63-1995" (Test) 18057.

"IESNA:LM-63-1995" (Test) 18100.

"IESNA:LM-63-1995" (Test) 18056.

* cited by examiner

*FIG. 3*
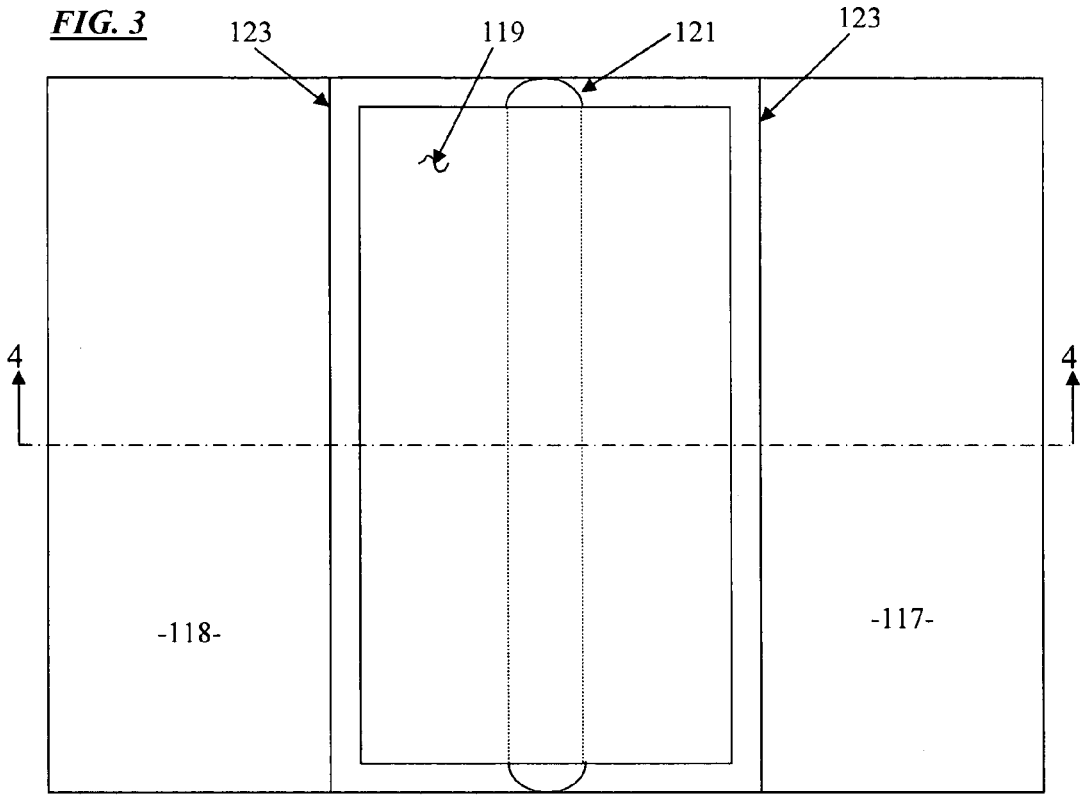
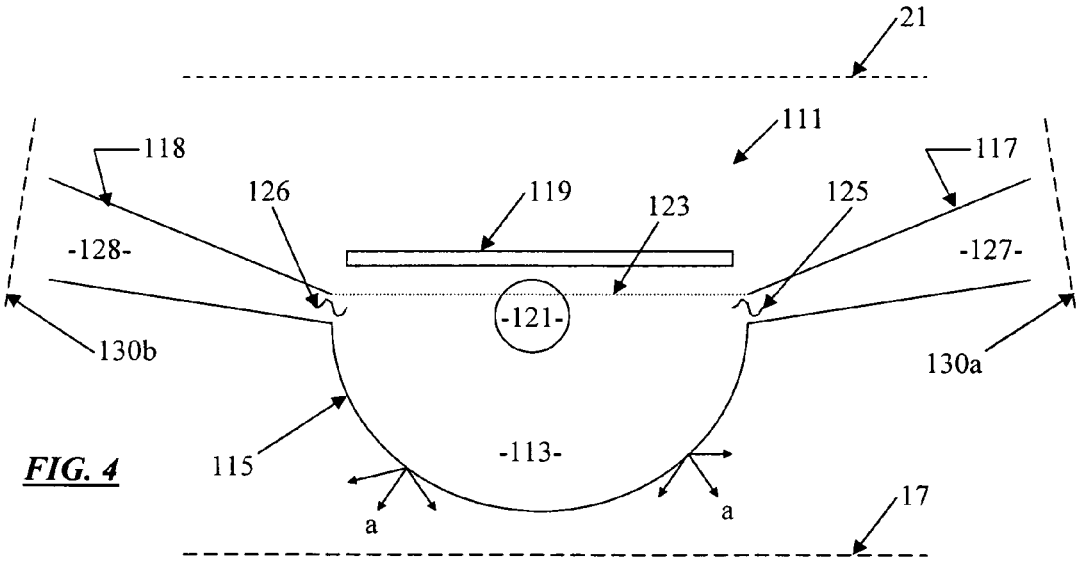
*FIG. 4*

FIG. 11
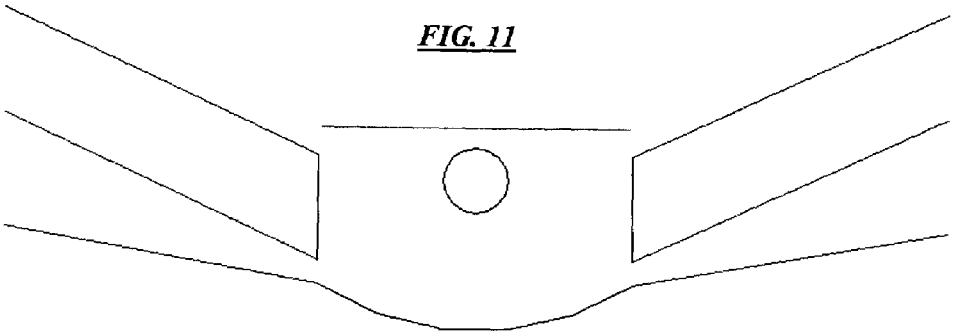
FIG. 12
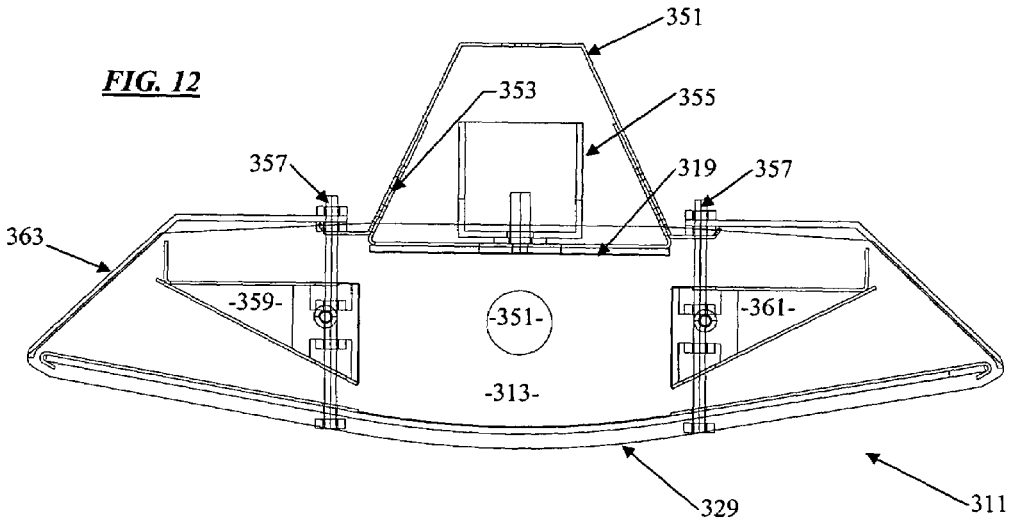
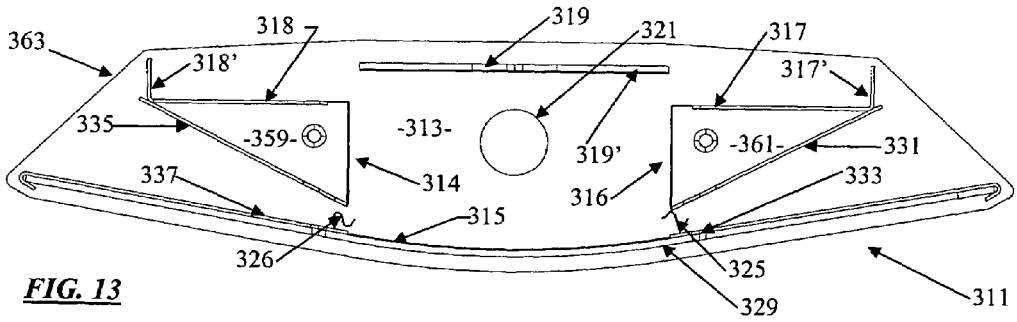
FIG. 13

CONSTRUCTIVE OCCLUSION WITH A TRANSMISSIVE COMPONENT

TECHNICAL FIELD

The present subject matter relates to techniques and equipment to provide radiant energy distribution, e.g. for lighting applications or the like, using constructive occlusion to provide desired distribution over one field and a transmissive component through a wall of the constructive occlusion structure to provide distribution of energy over another field.

BACKGROUND

Radiant or electromagnetic energy emitters and distributors find a wide range of applications in modern society. Visible illumination systems, for example, illuminate areas and surfaces to enable use by personnel in locations or situations in which natural ambient lighting might be insufficient. Infrared illumination is a critical component of many night-vision technologies. Other lighting devices provide guidance or warnings, for example to enable pilots to locate the edges of runways or taxiways, to illuminate emergency exit paths, to visibly indicate an emergency condition, etc. Different applications of radiant energy illumination systems require different performance characteristics.

Simple radiation sources, such as light emitting diodes (LEDs) or light bulbs with reflectors and/or lenses typically provide a high intensity radiation in regions close to the axis of the field of view/illumination, but the intensity drops off quickly at off-axis angles approaching the horizon. On a system illuminated by such a source, the intensity is not uniform. To provide a desired illumination at edges of a design footprint, the source often will emit substantially higher amounts of radiation than necessary along the axis.

Prior attempts to provide desired intensity distributions have involved complex arrangements of sources, lenses and reflectors. These complex arrangements tend to be relatively expensive and sensitive to problems of misalignment, which limits ruggedness and durability.

U.S. Pat. No. 5,733,028 issued Mar. 31, 1998 to Ramer et al. discloses a number of embodiments of illumination systems that utilize constructive occlusion. With this technology, a mask occludes an active optical surface, typically a Lambertian surface formed by the aperture of a diffusely reflective cavity, in order to distribute radiant energy with a tailored intensity distribution. Adjustment of the parameters of the constructive occlusion system enables the system designer to tailor the system performance to a wide range of applications. Constructive occlusion typically emphasizes distribution based on multiple diffuse reflections within a mask and cavity system. Careful selection of the system parameters, such as relative sizes of the mask and aperture and the distance between the mask and aperture, can adapt the constructive occlusion system to meet the requirements of many diverse illumination applications.

U.S. Pat. No. 6,334,700 issued Jan. 1, 2002 to Ramer et al. discloses constructive occlusion systems, which also provide a direct illumination component. The constructive occlusion provides a desired intensity illumination over one field, and direct radiation from the source, through a gap, opening or lens or the like, illuminates an additional field. The fields may overlap, or they may be separated. In several of the examples disclosed in this patent, the direct illumination provides a higher intensity illumination than the tailored intensity illumination provided by the constructive occlusion.

U.S. Pat. No. 6,286,979 issued Sep. 11, 2001 to Ramer et al. discloses constructive occlusion systems, but this patent teaches addition of a port from the constructive occlusion cavity and a reflective fan as a deflector to distribute additional energy emerging through the port into a desired region to be illuminated. With respect to the port and fan, the cavity and mask of the constructive occlusion system serve as the optical integrating cavity. The constructive occlusion emissions provide a tailored intensity distribution for radiant energy illuminating a first region. The integrating cavity, port and deflector (fan) distribute another portion of the electromagnetic energy over a second field of intended illumination. The first and second regions illuminated may overlap slightly, or one may include the other, but preferably most of the two regions are separate. In some cases, the system configuration creates a dead zone between the two regions.

The techniques disclosed in the identified patents allow a system designer to distribute light or other radiant energy in a wide range of different patterns, for a myriad of diverse illumination applications. However, even these techniques do not satisfy the requirements of all desired applications.

Consider indirect illumination as an example. Indirect illumination involves radiating energy against a face structure, which in turn reflects the energy into a region of actual interest. In lighting a room, for example, an indirect lighting type fixture might directly radiate or illuminate a wall or ceiling. Actual illumination of a work area in the room would then use light reflected (indirect illumination) from the wall or ceiling. To provide desired intensity and a pleasing appearance of the lighting fixture, however, it would be desirable if the fixture provided at least some light emission into the room without reflection from the face structure, although the main illumination may still be that provided indirectly through illumination against the ceiling or wall.

SUMMARY

The concepts disclosed herein provide constructive occlusion type radiant energy distribution as well as a diffuse distribution component of energy passing through a transmissive wall of the constructive occlusion system. For example, a diffusely reflective wall of the cavity may allow some energy to pass through and provide an additional illumination component, while continuing to maintain the characteristics to support the constructive occlusion component.

To maintain constructive occlusion type operation, diffusely reflective materials typically should have a reflectivity of at least 85%, for example, on the wall of the cavity and often on the surface of the mask. In practice, the efficiency of the lighting system increases as this reflectivity increases. However, if the reflectivity of the transmissive structural element is too high, there will not be sufficient light passing through that system wall to support the desired transmissive lighting. Practical examples of the constructive occlusion lighting system with a transmissive component utilize materials that exhibit approximately 96% reflectivity of the light from the source. Diffusely reflective materials typically are white or nearly white, although there may be some coloration, for example, off-white or gray.

For example, an indirect lighting system may include a light source and an optical cavity for receiving light from the source. At least a section of the cavity wall is transmissive, so as to pass a first portion of the light from the source toward a first field of illumination. The section of the cavity wall also is somewhat diffusely reflective, so that the wall section diffusely reflects some of the light from the source within the cavity. This disclosed system includes a processing element outside the cavity wall, for further processing of the light transmitted through that wall. For purposes of discussion here, the processing element is referred to generically as a baffle. The baffle is at least partially transmissive so as to pass at least some of the first portion of the light through to the first field of illumination. An aperture of the optical cavity faces toward a second field of illumination. The system includes a mask, spaced from the aperture and having a reflective surface facing toward the aperture. The mask is positioned relative to the aperture so as to occlude a substantial part of the aperture. As a result, the system provides a tailored distribution of a second portion of the light emerging from between the mask and aperture over a second field of illumination. A support enables mounting or attachment of the lighting system in relation to a face structure, such as a wall or ceiling, in such a manner that the diffused first portion of the light provides direct illumination in the first field. When so attached, the second portion of the light illuminates the second field onto the face structure, for reflection and indirect illumination of the first field with reflected light from the second portion.

The system may also be arranged to provide emission of a third portion of the light from the source over a third field of illumination. This may take the form of direct illumination from the source, through a gap between the mask and the perimeter of the aperture. Alternatively, this arrangement may comprise a port through the cavity, for emitting the third portion of the light from the source toward the third field of illumination. Ported cavity examples, disclosed herein, also utilize a deflector coupled to the port and having a reflective surface expanding outward as the deflector extends from the port toward the third field of illumination, for directing the third portion of light from the source over the third field of illumination.

The lighting systems disclosed herein may utilize a variety of reflective materials. For example, the cavity wall may comprise a diffusely reflective material providing at least 85% reflectivity of the light from the source back within the cavity. Similarly, the reflective surface of the mask may comprise a diffusely reflective material providing at least 85% reflectivity of the light. Higher efficiencies are attained with higher reflectivities, and examples are disclosed in which both the cavity wall and the mask surface are substantially white and exhibit reflectivities of approximately 96% or higher.

The baffle is partially transmissive, and in most examples is also somewhat reflective, to reflect some light or other energy back toward the wall of the cavity. As used here, the term baffle refers to any element for processing the light or radiant energy so as to check, deflect, filter, refract, distribute or diffuse or otherwise process the light or radiant energy. In a number of examples discussed in detail below, the baffle is partially reflective and partially transmissive much like the wall of the cavity, although the degree of reflectivity may be different from that of the wall. The partially transmissive baffle typically takes the form of a diffuser. In several examples, this diffuser comprises a sheet of a substantially white, translucent material. Of course, other diffuser structures may be used, such as perforated metal (e.g. Steel or Aluminum) painted or otherwise coated with a diffusely reflective material.

The subject matter disclosed also encompasses a system for projecting electromagnetic radiation, comprising a source of the electromagnetic radiation, an optical cavity, an aperture and a mask. The optical cavity receives the electromagnetic radiation from the source. At least a section of the cavity wall is transmissive, in that it passes and diffuses a first portion of the electromagnetic radiation from the source over a first field of illumination. The section of the cavity wall is also somewhat diffusely reflective, for diffusely reflecting a second portion of the electromagnetic radiation from the source within the cavity. An aperture of the optical cavity faces toward a second field of illumination. The mask has a reflective surface facing toward the aperture, and the mask is positioned relative o the aperture so as to occlude electromagnetic radiation emerging from the cavity through the aperture with respect to the second field of illumination.

Examples of this later system are disclosed which further comprise a partially transmissive baffle, such as a white diffuser, located outside the cavity. The partially transmissive baffle processes and transmits at least some of the first portion of the electromagnetic radiation to the first field of illumination.

In another aspect, a lighting system is disclosed which includes a light source, a diffuse reflector for diffusely reflecting light from the source and two transmissive diffusers. The first transmissive diffuser passes and diffuses a first portion of light from the source and from the diffuse reflector. This first diffuser also reflects a second portion of the light from the source and the diffuse reflector. The second transmissive diffuser reflects and diffuses a first portion of the light from the first diffuser, but it also passes a second portion of the light from the first diffuser. In several examples, the second diffuser diffuses the second portion of light from the first diffuser over a first field of illumination. A gap is formed between the diffuse reflector and the first diffuser, which allows emission of additional light from the source over a second field of illumination.

Disclosed examples of the diffuse reflector and the first diffuser typically are implemented in the form of a mask and cavity system. In such examples, the first diffuser comprises a diffusely reflective cavity, and the diffuse reflector constructively occludes an aperture of the cavity with respect to the second field of illumination.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 3 is a plan view of a lighting system providing a transmissive illumination component, in combination with illumination via a mask, cavity and shoulder, and illumination through a pair of ports and deflector structures.

FIG. 4 is a cross-sectional view of the lighting system of FIG. 3 taken along line 4—4.

FIGS. 7 to 11 are line drawings showing the optical surfaces of further exemplary lighting systems similar to those of FIGS. 3 to 6.

FIGS. 12 to 16 are various views of a prototype lighting system providing both a transmissive illumination component and illumination by constructive occlusion, showing the addition of a second diffuser for additional processing of the transmissive illumination component.

DETAILED DESCRIPTION

Figure 1:
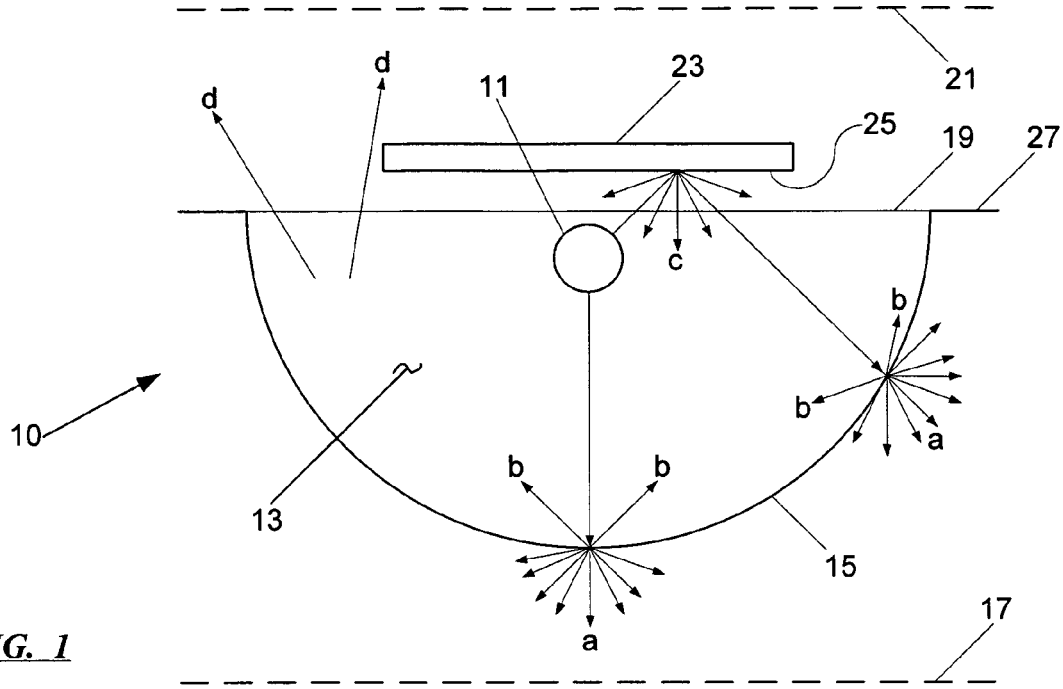
FIG. 1 is a cross-sectional view of a simple embodiment of an illumination system providing both a transmissive illumination component and illumination by constructive occlusion.

The various examples of lighting systems disclosed herein combine constructive occlusion type illumination with a transmissive illumination component. Constructive occlusion type lighting systems utilize a reflective mask to cover a portion of an active optical surface, typically a Lambertian surface formed by the aperture of a diffusely reflective cavity, in order to distribute radiant energy with a tailored intensity distribution. Adjustment of the parameters of the constructive occlusion system enables the system designer to tailor the system performance to a wide range of applications. As disclosed herein, the constructive occlusion type distribution is combined with a transmissive illumination component, typically transmitted and diffused through a wall of the system. For example, a diffusely reflective wall of the cavity may also be partially transmissive, to allow some of the radiant energy to pass through and provide an additional diffuse illumination component, while continuing to maintain the characteristics to support the constructive occlusion component.

A constructive occlusion type system typically comprises a base and a mask. A "base" is the bottom of anything, in this case, the base the bottom element of the system, with respect to the energy processing for constructive occlusion, although those skilled in the art will recognize that the base may appear in other positions if the system is oriented differently. In general, a "mask" is a covering for an area of something. In the systems disclosed herein, a mask is an object that covers a portion of an active area formed on the base, typically, the opening or aperture of a cavity formed in the base. The word "cavity" refers to any hollow place.

The mask constructively occludes a substantial portion of the active optical area of the base. The verb "occlude" means to close, shut or stop up a passage, opening, etc. The occlusion under discussion herein relates to blocking or covering a portion of the active area, typically the aperture of the cavity through which light or other radiant energy would otherwise emerge from the cavity. For example, the mask blocks a substantial portion of the light or other radiation that otherwise comes from that area or aperture, and may be considered to substantially block that part of the area or opening with respect to the radiant energy that it reflects back into the area or cavity. The occlusion provided by the mask is "constructive," in that it is beneficial, it tends to help to improve system performance in a desired way, as opposed to a destructive blockage of energy emissions.

Those skilled in the art will recognize that the principles discussed herein are applicable to distribution of various forms or wavelengths of radiant energy or electromagnetic radiation. The preferred embodiments relate to illumination with visible light, and the following discussion will concentrate on discussion of lighting systems, although clearly the concepts encompass radiation of other forms of electromagnetic energy.

Reference now is made in detail to the examples illustrated in the accompanying drawings and discussed below. Relative sizes and dimensions in the drawings are illustrative only. The drawings are not necessarily shown to scale.

FIG. 1 depicts a first, simple embodiment of a lighting system 10, for projecting or emitting light over two fields to be illuminated. The system 10 diffusely illuminates a first field (downward in the exemplary orientation), and the system 10 projects light with a tailored intensity distribution by constructive occlusion, over a second field of illumination (upward in the exemplary orientation). If the second field includes a somewhat reflective facing surface, e.g. a substantially white ceiling or wall, light reflected from that field adds indirect illumination onto the first field.

The drawing shows a system 10 for projecting electromagnetic radiation, in the example, visible light. The system 10 includes a source of the electromagnetic radiation, shown by way of example as a lamp 11 or other light source. The lamp 11 could be one or more light bulbs, one or more light emitting diodes (LEDs), one or more fluorescent or neon light tubes, etc.

The system 10 includes an optical cavity 13 for receiving the electromagnetic radiation, light in the example, from the source 11. The cavity 13 has a wall 15. At least a section of the cavity wall 15 is somewhat transmissive with respect to light of the wavelength(s) emitted by the source 11. Hence, that part of the wall 15 passes and diffuses a first portion of the electromagnetic radiation, in the example, from the light source 11, over a first field of illumination represented generally by the dotted line at 17. If viewed from the first field 17, the transmissive cavity wall 15 appears as a light diffuser.

The cavity wall 15 has a diffusely reflective inner surface. This inner surface diffusely reflects a second portion of the electromagnetic radiation from the source 11 within the cavity 13. An aperture 19 of the optical cavity 13 faces toward a second field of illumination, represented generally by the dotted line at 21. The system 10 also includes a mask 23. In the example, the mask 23 is located outside the cavity 13 and is spaced from the aperture 19. At least the surface 25 of the mask 23, which faces toward the aperture 19, is reflective. The facing surface 25 may have a specular or other reflective characteristic, but preferably, that surface is diffusely reflective. The mask 23 is positioned relative to the aperture 19 so as to occlude electromagnetic radiation (e.g. light) emerging from the cavity 13 through the aperture 19 with respect to the second field of illumination 21.

In the example, a shoulder 27 extends along at least a portion of the perimeter of the aperture 19. The shoulder surface preferably has a reflective characteristic with respect to the electromagnetic radiation. Depending on desired performance characteristics, the shoulder 27 may be specular, quasi-specular, diffusely reflective, quasi-diffusely reflective, or striped in combinations of different reflective characteristics.

In the example, the inner surface of the cavity wall 15 is highly diffusely reflective, and at least the facing surface 25 of the mask 25 is similarly diffusely reflective. The diffuse reflective surfaces may be formed by white paint or other coatings on appropriate substrates or by molding of white reflective plastic materials. In one example, the cavity wall 15 comprises Tyvek®, which is a white sheet material exhibiting approximately 96% reflectivity, with a diffusely reflective characteristic. The mask 23 may be molded Spectralon® or formed of a substrate formed of a rigid plastic or metal (e.g. Steel or Aluminum) or the like painted with a high gloss white paint, or formed of any other diffusely reflective material, such as Ferro Corporation's high reflectance polyolefin plastic. White paper will actually provide a sufficient diffuse reflectivity (at about 90%) and may be used as either the cavity wall or the mask surface.

For applications/arrangements of the system 10 expected to have a relatively high level of heat and temperature, construction of diffusely reflective surfaces may use a diffusely reflective coating formed of a white oxide pigment and an inorganic binder. The preferred examples of such coatings comprise uncalcined zinc oxide pigment and a potassium silicate binder, and may include a relatively small amount of propryonic acid as a dispersing agent. An example of this type of paint is sold by Advanced Optical Technologies, under the name AOT White 96™. See also U.S. patent application publication no. 20030183753 to Brown. For low temperature applications/arrangements of the system 10 (e.g. using fluorescent tube sources), other white materials may be used. If coating is preferred for such a low temperature application, for example, a white barium paint is often quite adequate.

The systems disclosed herein can use any diffuse reflective material, for the cavity wall and/or the facing surface of the mask. However, the more reflective, e.g. 96%, the better the performance. Changing the material of the cavity and/or the mask and thus the reflectivity does not change the distribution, only the output intensity.

A reflective surface is never a perfect reflector. Although most of the energy may be reflected, some passes into the material. If the material is thick or the surface is formed on a solid (opaque) substrate, the light entering the material is absorbed. However, if the structure or material is partially transmissive, at least some of the non-reflected energy passes through. In the system 10, the wall 15 has a substantial reflective characteristic, but it is also somewhat transmissive. A substantial portion of the non-reflective light passes through toward the first field to be illuminated, i.e. toward the field 17. In the example using Tyvek®, the wall 15 passes and diffuses some light from the cavity 13, as represented by the arrows a. The Tyvek® wall 15 also diffusely reflects light back into the cavity 13, as represented by the arrows b. As noted, Tyvek® is approximately 96% reflective. A substantial portion of the remaining 4% passes through and is diffused by the material.

In many embodiments, the cavity 13 comprises a substantial segment of a sphere. For example, the cavity 13 may be substantially hemispherical as represented by the illustrated cross-section. However, the cavity's shape is not of critical importance. A variety of other shapes may be used. For example, half-cylindrical cavities having a square or rectangular aperture or even having a nearly linear aperture with a narrow rectangular opening are contemplated for certain specific applications requiring a more rectangular illumination footprint in one or both of the fields. Practically any cavity shape is effective, for purposes of the constructive occlusion portion of the operation, so long as the cavity wall 15 has a diffuse reflective inner surface. A hemisphere is preferred for discussion purposes and for the ease in modeling its azimuthal symmetry. In the example, it may also be useful to assume that the aperture 19, mask 25 and shoulder 27 are circular, although other shapes may be used.

As noted, system 10 may include a variety of different types of light sources 11. In the example shown, the light source 11 is an idealized spherical source emitting radiation in virtually all directions. Such a source 11 may be at any convenient location between the mask and cavity or adjacent to either the surface of the cavity or the surface of the mask.

In the context of the constructive occlusion type system 10, the material forming the inner surface of the wall 15 of the cavity 13 provides a highly efficient Lambertian surface having a diffuse high-reflectance, for at least visible light wavelengths. Because of the integrating nature of the space between the cavity wall and the facing surface 25 of the mask, the aperture 19 becomes a virtual Lambertian surface. A Lambertian surface emits light with substantially uniform intensity in all directions. The virtual Lambertian surface formed by the aperture 19 is the active optical area of the base.

In the example, the mask 23 is relatively flat, although it may have a variety of other shapes, for example to help enclose a relatively large embodiment of the lamp 11. Although only the facing surface 25 should always be reflective for constructive occlusion, it is often desirable to construct the mask 23 to be reflective in some fashion (e.g. varying degrees of specular and/or diffuse reflectivity) on the ends/sides of the mask and sometimes even on the surface of the mask opposite to the facing surface 25.

The light source 11 emits light into the cavity 13 and/or toward the facing surface 25 on the mask 23. The light source 11 also emits some light directly through the gap between the mask 23 and the perimeter of the aperture 19, and the light source 71 may direct some light toward the shoulder 27. As noted, the cavity wall 15 transmissively passes and diffuses some portion of the light downward, as represented by the exemplary rays a. In a system using a highly reflective material, e.g. Tyvek®, for the wall 15, on any given ray impacting the wall, about 96% is reflected. Of the other 4%, most passes through, but some amount is absorbed by the material. Because of the repeated reflections between the surfaces of the cavity 13 and the mask 23, the total light energy transmitted through the wall 15 is actually substantially higher than 4%. In an example discussed later (regarding FIGS. 12–16), using a Tyvek wall (and a secondary diffuser), the system provides around 20% (e.g. 18–21%) of the light energy as rays a directed toward the first field 17. The degree of transmissivity of the cavity wall may vary at different locations or areas of the wall, e.g. due to differences in the internal structure of the wall material, due to variations in thickness, etc. In some applications, it may be desirable to vary the transmissivity, reflectance and/or translucence of the cavity wall, to control the amount of energy distributed in a particular direction or along a particular axis.

In addition, the system 10 provides constructive illumination of the second field 21. The light source 11 may emit some light directly through the gap between the aperture 19 and the edges of the mask 25. Light rays impacting on the diffusely reflective surfaces, particularly those impacting on the inner surface of the cavity 13 and the facing surface 25 of the mask 23, reflect and diffuse one or more times within the confines of the system 10, as represented by the exemplary ray arrows b and c. After one or more such diffuse reflections, light eventually emerges through the gap between the perimeter of the aperture 19 and the edges of the mask 23, as represented for example by the arrows d. If reflective, the shoulder 27 and possibly side surfaces of the mask 23 reflect some portion of this light d toward the second field 21 of intended illumination, contributing an additional component to the illumination of that field.

For purposes of constructive occlusion, the cavity 13 may be considered to have an active optical area, formed by the inner surface of the wall 15 or more often by the aperture 19, each of which exhibits a substantially Lambertian energy distribution. Where the cavity 13 is formed in a base (not separately shown), for example, the planar aperture 19 formed by the rim or perimeter of the cavity 13 forms the active surface with substantially Lambertian distribution of energy emerging through the aperture. The cavity may be formed in the facing surface of the mask 25. In such a system (not shown), the surface of the base would be a diffusely reflective surface, therefore the active area on the base would essentially be the mirror image of the cavity aperture on the base surface, that is to say the area on the base reflecting energy emerging from the aperture of the cavity in the mask.

In accord with principles of constructive occlusion, the mask 23 occludes a portion of the optically active area of the base. In the example of FIG. 1 the optically active area of the base is the aperture 19 of the cavity 13; therefore the mask 23 constructively occludes a substantial portion of the aperture 19, including the portion of the aperture on and about the axis of the mask and cavity system.

The relative dimensions of the mask 23 and aperture 19, for example the relative diameters or radii in the circular embodiment, as well as the distance of the mask 23 away from the aperture 19, control the constructive occlusion performance characteristics of the lighting system 10 with respect to the second field 21. Certain combinations of these parameters produce a relatively uniform intensity with respect to angles of emission, over a wide portion of the field 21, about the system axis (vertically upward in FIG. 1). Other combinations of relative sizes and height result in a system performance over the second field 21 that is substantially uniform with respect to a wide planar surface perpendicular to the system axis at a fixed distance from the aperture. For example, if the dotted line 21 represents a wall or ceiling, the constructive occlusion emission may provide substantially uniform illumination over an area or "footprint" on that facing structure.

If the shoulder 27 is provided and is reflective, the shoulder 27 also reflects at least some light upward toward the field 21. The angle of the shoulder 27 and the type of reflectivity of the surface thereof facing toward the region 21 to be illuminated by constructive occlusion also contribute to the intensity distribution over that region. In the illustrated example, the diffusely reflective shoulder 27 is in or parallel to the plane of the aperture 19, although the shoulder may be at an angle (e.g. up or down) with respect to that plane to provide a desired performance.

In the example, the constructive occlusion illumination operation of the system 10 provides an illumination component over the second field 21. The two fields may be close or overlap, but in the example, they are in opposite directions. Where there is an ambient surface, such as wall, ceiling or other structural face in the field 21, that face structure reflects at least a substantial portion of the light directed to the field 21 back for an added, indirect illumination of the first field 17. As shown in later embodiments, indirect lighting type examples of the system will often include a support, for attaching the lighting system in relation to the face structure, so that the constructive occlusion lighting component illuminates the face structure for reflection and thus provides indirect illumination of the first field 17 with light reflected from the second field 21.

In selecting the particular materials and their reflective characteristic, the intent is allow light to pass through to create the additional component rays shown at a, but still maintain the reflective efficiency of the mask and cavity so as to enable/maintain the constructive occlusion, i.e. so that the cavity and mask still function essentially as an integrating cavity with respect to the desired energy wavelength(s). In constructive occlusion, the luminous area is no longer the light source, instead the luminous area becomes the open area (the un-occluded portion of the area), so long as the reflective properties of the mask and cavity are sufficient to maintain this characteristic. The transmissive component or other energy losses can not take away so much light that the mask and cavity no longer produces this characteristic.

To maintain constructive occlusion type operation, diffusely reflective materials typically should have a reflectivity of at least 85%, for example, on the wall of the cavity and often on the surface of the mask. In operation, the efficiency of the lighting system increases as this reflectivity increases. However, if the cavity reflectivity is too high, there will not be sufficient light passing through the cavity wall to support the desired transmissive illumination component. Practical examples of the constructive occlusion lighting system with a transmissive component utilize materials that exhibit approximately 96% reflectivity of the light from the source. Diffusely reflective materials typically are white or nearly white, although there may be some coloration, for example, off-white or gray.

Figure 2:
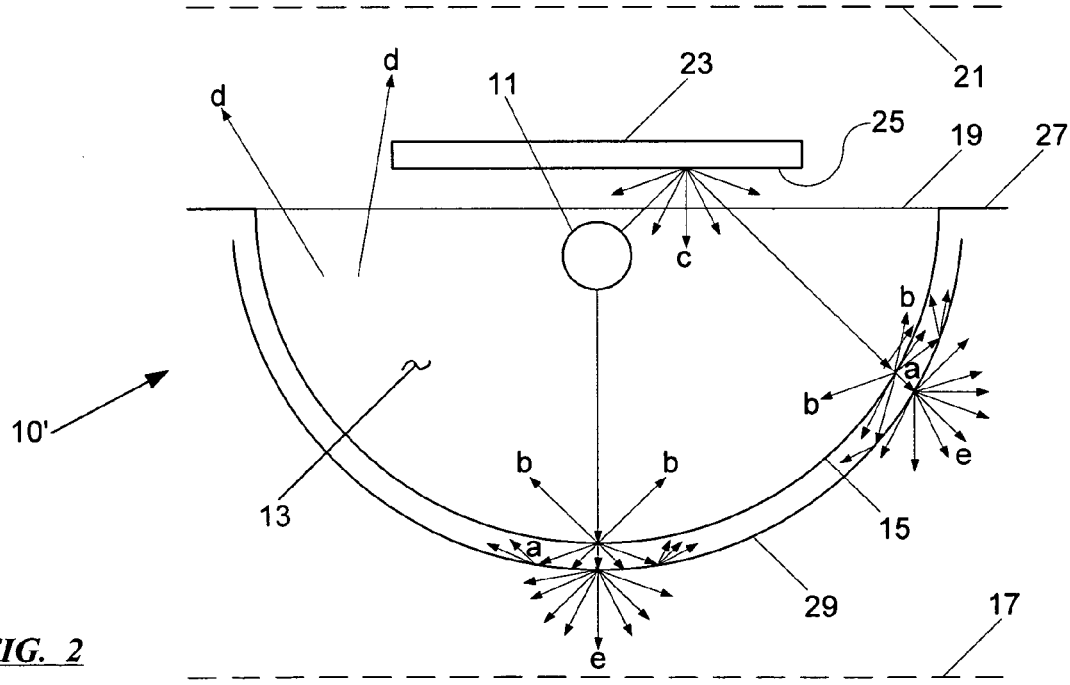
FIG. 2 is a cross-sectional view of another embodiment of an illumination system providing both a transmissive illumination component and illumination by constructive occlusion, showing the addition of a second diffuser for additional processing of the transmissive illumination component.

FIG. 2 shows a second example 10' of a lighting system. The system 10' is essentially similar to the system 10 of FIG. 1, and like elements shown in the two drawings are indicated by the same reference numerals. In general, system operation is similar to that described above relative to FIG. 1.

The system 10' includes a processing element outside the cavity wall, for further processing of the light or other radiant energy transmitted through that partially reflective/partially transmissive wall. For purposes of discussion here, the processing element is referred to generically as a baffle, which means that this element is for processing the light or radiant energy so as to check, deflect, filter, refract, distribute or diffuse or otherwise process the light or radiant energy. In several examples, the baffle is partially reflective and partially transmissive much like the wall of the cavity, although the degree of reflectivity may be different from that of the wall.

As noted in the discussion of FIG. 1, for purposes of direct lighting of the first field 17, the wall 15 of cavity 13 functions as a first diffuser. The system 10' of FIG. 2 includes a second at least partially transmissive processing element, or "baffle," in this example in the form of a second diffuser 29. The second diffuser 29 may actually be a substrate on which a white coating forms the wall 15, or it may be a separate component. In some examples, the material of the second diffuser adds strength or rigidity to the cavity wall 15. However, the material and configuration of the second diffuser 29 may be chosen to provide an additional distribution or control function with regard to dispersal of the light rays a over the first field 17 that is being illuminated by the system 10.

In the example, the second diffuser 29 is a partially transmissive and partially reflective baffle structure. The diffuser 29, for example, may be formed of a sheet of a translucent substantially white glass or plastic material.

Those skilled in the art will recognize that other diffuser structures or materials may be used, such as perforated metal (e.g. Steel or Aluminum) painted or otherwise coated with a diffusely reflective material. The second diffuser 29 is positioned outside the cavity wall 15 so as to reflect and diffuse a part of the light rays a back toward the cavity 13 and to transmit and diffuse another part of the light rays, as further diffused rays e over the first field of illumination 17. Like the cavity wall, the second diffuser 29 may be constructed so that its transmissivity, reflectance and/or translucence varies at different points or areas, for example, to control the amount of energy that is distributed in a particular direction or along a particular axis.

The systems disclosed herein also include means for providing emission of a third portion of the light from the source over a third field of illumination. In the examples discussed below, this means comprises one or more ports, positioned to allow emission of light from the cavity toward the third field of illumination. In the elongated troffer examples, there is one such port along each side of the system. Each port typically has an associated deflector, with interior reflective surfaces, to help efficiently direct light to the third field. Use of ports and deflectors in constructive occlusion lighting systems is described in more detail in U.S. Pat. No. 6,286,979, and the disclosure of such ports and deflectors from that patent is incorporated entirely herein by reference. Those skilled in the art will recognize, however, that the means for providing emission of a third portion of the light from the source over a third field of illumination may take other forms. For example, the mask may be sized and the source positioned so to enable direct emission of some light from the source, or the port(s) may be positioned to provide direct emissions. Direct illumination from a constructive occlusion system is described in more detail in U.S. Pat. No. 6,334,700 issued Jan. 1, 2002 to Ramer et al., and the disclosure of direct illumination in that patent is incorporated entirely herein by reference.

FIG. 3 is a plan view and FIG. 4 is a cross-sectional view of an example of a lighting system, similar to that of FIG. 1, but providing an additional direct illumination component and using an elongated light source. This particular system 111 is optimized for providing an up-light illumination, albeit with additional components radiated out in areas nearing the horizon to the right and left sides of the system. Although the system 111 may be oriented in other directions, in the illustrated orientation, the constructive occlusion component and the additional components are generally directed upward to illuminate a relatively wide second field, for example, across a ceiling or wall where the system 111 is used for an indirect downward lighting application.

The system 111 takes the form of a fluorescent light fixture, being somewhat longer than it is wide (FIG. 3). For ease of illustration, the relative length and width dimensions, however, are not accurate as to scale and relative size. Actual implementations will typically be considerably longer than shown in FIG. 5.

As in the earlier embodiments, the system 111 comprises a base having a diffusely reflective cavity 113 having an outer wall 115. The cavity wall 115 takes the form of a portion or segment of a cylinder, such as a half-cylinder with closed ends. Such a cavity presents a rectangular aperture toward the second (upward) area to be illuminated. The semi-cylindrical cavity is preferred here for purposes of discussion, illustration and ease of modeling, however, as in the earlier discussions, the cavity may have almost any convenient shape or contour.

Examples having the cross section of FIG. 4 may be circular; or as shown, the system 111 may be rectangular. The illustrated version exhibits a relatively wide rectangular aperture 123. For some applications it may be desirable to lengthen the system and narrow the cavity and aperture such that the long narrow aperture approximates a nearly linear opening or slit.

In this embodiment, ports 125, 126 are formed along respective boundaries between the sides of the cavity 113 and the shoulders 117, 118. Consequently, the inner edges of the shoulders 117, 118 actually define the aperture 123 for constructive occlusion purposes with respect to the second field of intended illumination. This aperture 123 is said to be the aperture of the base-cavity 113 and define the active optical area of the base essentially as if the sides of the cavity extended to the inner edges of the shoulders 117, 118 (without side ports 125, 126).

In this example, the source 121 is an elongated tubular source, such as a fluorescent lighting tube. The ballast, the housing for the ballast and the structure for mounting or supporting the system 111 are omitted, for ease of illustration.

A mask 119 constructively occludes light diffused within the cavity 113 from the source 121 and passing through a cavity aperture 123. The mask 119 has a diffusely reflective surface facing toward the aperture 123. In one actual implementation of this embodiment, the ratio of the dimensions, of the mask 119 relative to the aperture 123, is 0.98.

In the illustration, the ends of the system above the base (top and bottom in the orientation of FIG. 3 or at the back when shown in the cross-section of FIG. 4) are open. Practical embodiments would typically include a wall across one or most often both ends. Also, the shoulder and fan structures could extend around one or both ends, depending on the desired illumination around the ends of the system 111.

At least a section of the cavity wall 115 passes and diffuses a first portion of the electromagnetic radiation, in the example, from the source light source 121, over a first field of illumination 17 similar to that in the example of FIG. 2. Typically, the wall 115 is formed of a material that is diffusely reflective and is partially transmissive, as in the earlier examples. If viewed from the first field 17, the wall 115 appears as a light diffuser. As in the earlier examples, the cavity wall 115 has a diffusely reflective inner surface. This inner surface diffusely reflects a second portion of the electromagnetic radiation from the source 121 within the cavity 113. However, again, the reflective surface of the wall 115 is not a perfect reflector and is partially transmissive as well. Although most of the energy may be reflected, some passes into and through the wall 115. In this manner, a substantial portion of the non-reflective light passes through the wall 115 toward the first field 17 to be illuminated. In the example using Tyvek®, the wall 115 passes and diffuses some light from the cavity 113, as represented by the arrows a. The Tyvek® wall 15 also diffusely reflects light (not shown) back into the cavity 113, as in the earlier examples.

The second field to be illuminated 21 is vertically above the system 111 in the orientation illustrated in FIG. 4 and is substantially centered about the vertical axis (180°). In this system 111, there are actually two shoulders 117, 118. The shoulders extend along the longer sides of the rectangular cavity 113 near the sides of the aperture 123. Essentially, each shoulder is constructed of a flat plate mounted at the desired angle with respect to the plane of the aperture 123. The upper surface of each shoulder, facing a portion of the second intended field of illumination 21, has a light reflective characteristic. In the preferred form of this embodiment, the surface of each of the two shoulders 117, 118 is specular, although a diffuse reflectivity or other reflective characteristic (or combinations thereof) could be used on the shoulders.

The up-light system of FIGS. 3 and 4 includes two ports 125, 126 providing rectangular openings into the opposing sides of the partially cylindrical cavity 113. The system 111 includes a deflector structure 127 coupled to the port 125 and a deflector structure 128 coupled to the port 126. The port 125 and the deflector structure 127 direct light from the cavity 113 toward the horizon on one side of the system (to the right in the drawings). Similarly, the port 126 and the deflector structure 128 direct light from the cavity 113 toward the horizon on the other side of the system (to the left in the drawings).

In the system of FIGS. 3 and 4, the plates forming the shoulders 117, 118 together with upper surfaces of the base form the two fan-shaped deflectors 127, 128, one of which is coupled to each of the elongated ports. The interior surfaces of the two fan-shaped deflector structures 127, 128 are substantially specular. In the deflector 127, one specular surface is formed on the underside of the plate forming the shoulder 117, and the other specular surface of that deflector is formed on the top surface of the base that forms or supports the cavity 113. Similarly, in the deflector 128, one specular surface is formed on the top surface of the base that forms or supports the cavity 113, and the other specular surface of the deflector is formed on the underside of the plate forming the shoulder 118.

The light source 121 is a fluorescent lamp, that is to say in the form of an elongated tube. In this example, the light source preferably is linear and extends along a substantial portion of the cavity 121, but other light sources could be used. For example, one or more remote lamps could transmit light to specific points along the cavity wall through a series of optical fibers coupled to openings through the base into the cavity or through the mask. Another approach might be to use a number of LEDs emitting light from points on the mask and/or the wall 115 of the cavity 113.

The source 121 could be positioned virtually anywhere so that its light passes into the space between the mask and cavity. However, in the example, the source 121 is located so that the source 121 transmits some portion of its light energy directly through the ports 125, 126 into and through the associated deflector structures 127, 128 toward the respective fields of illumination 130*a* and 130*b*. With the ports and deflectors located substantially as shown, the fluorescent lamp 121 should reside near the surface of the mask 121, to maximize the output into the third and fourth regions 130*a* and 130*b* illuminated by the system. The respective fields 130*a* and 130*b* illuminated by light emerging through the deflectors 127, 128 are out (to the right and left, respectively) near the edges of the second field 21 that is illuminated by the constructive occlusion, in this example.

With respect to the mask 119, the cavity aperture 123 appears to be a planar Lambertian diffusion surface or source. With respect to each port and fan-shaped deflector structure, the combination of the mask 119 and the cavity 113 forms an integrating cavity for efficiently coupling light from the source 121 through the respective port 125 or 126.

The port and fan structures provide relatively high-intensity illumination out toward the horizon of the system 111. The constructive occlusion provides a lower intensity illumination of the second field, e.g. directly above the system in the illustrated orientation. The constructive occlusion illumination extends outwards towards the horizon and to some extent overlaps the areas illuminated through the deflectors 127 and 128.

In the illustrated orientation, the system 111 provides illumination downward (0°), by virtue of the diffuse illumination transmitted from the cavity 113 through the partially transmissive wall 115 (as shown by way of example by the ray arrows a). The system also provides indirect illumination for reflection off a facing surface (not shown) at angles from the axis (vertical, 180°) outward and approaching the horizon (90° and 270°). However, in the region just above the horizon, the deflector structure 127 or 128 provides a relatively high-intensity illumination, for example from approximately 95° to 125° (or 265° to 235°). The illumination intensity tapers off to a more uniform level, provided by the constructive occlusion for angles ranging from about 145° to 180° or about 225° to 180° (around the vertical).

The system 111 may be used as a "troffer" type indirect lighting system, with a fluorescent lamp source, hanging down from but aimed up toward a ceiling. The indirect illumination of an area by such a lighting system 111 relies on light bouncing down off of the ceiling. In the example, the indirect lighting is combined with the diffuse illumination by the rays a passing through and diffused by the cavity wall 115 (toward the first field of illumination).

In the illustrated example, the fans or deflectors 127, 128 used relatively flat surfaces to reflect and direct the light emerging through the ports 126 and 127 out toward the edges of the second field of illumination (approaching the horizon). Although not shown, other examples may use curved deflectors. The curvature of the plates forming the deflectors provides an added degree of structural strength and rigidity. The resulting curved deflectors, however, provide substantially the same distribution of light over the respective fields of illumination as do the flat-plate deflectors 127 and 128 in the example of FIGS. 3 and 4.

In the ported cavity and fan example shown (FIGS. 3 and 4), the ports are at or near the aperture, and the deflectors extend out toward the horizon, to produce an upward illumination approaching the horizon, as described above. For other applications, however, one or more such port and fan type deflector arrangements may be coupled to the mask and/or to other elevations of the cavity wall 115, to provide alternative or additional directed illumination in other regions as needed to support other types of lighting applications.

Figure 5:
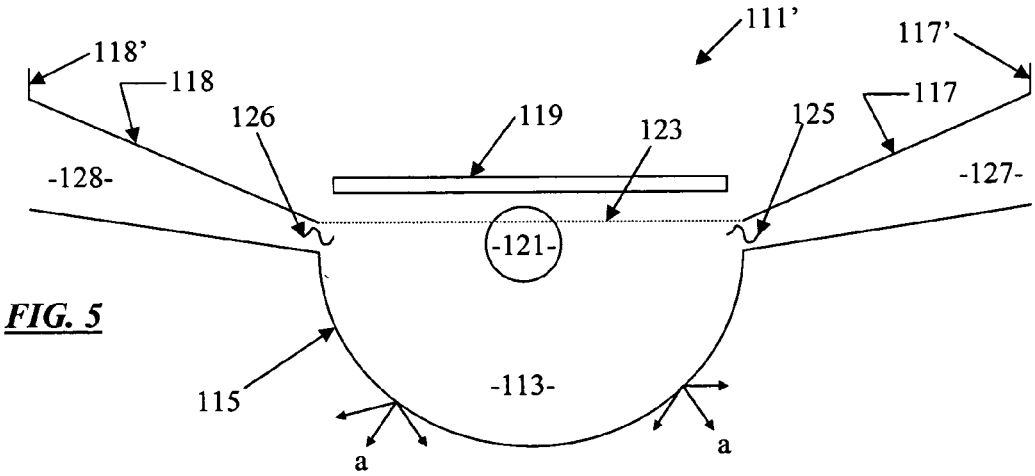
FIG. 5 is a cross-sectional view of a lighting system similar to that of FIGS. 3 and 4, with upstanding side reflectors added to the shoulder elements.

FIG. 5 shows another example 111' of a lighting system. The system 111' is essentially similar to the system 111 of FIGS. 3 and 4, and like elements are indicated by the same reference numerals. In general, system operation is similar to that described above relative to FIGS. 3 and 4. In this example, each shoulder 117, 118 includes a perpendicular reflector section 117', 118'. The upper edges of these reflector sections 117' and 118' limit the range of light emission from the mask and cavity type constructive occlusion illumination out toward the horizon and thus reduce overlap with illumination from the ports and deflectors.

In the preferred form of this embodiment, the surface of each of the two shoulders 117, 118 is specular, including the surface of the respective perpendicular reflector section 117', 118'. Those skilled in the art will understand that other reflective materials may be used, for example to provide a diffuse reflectivity, a retro-reflective characteristic or other reflective characteristic (or combinations thereof). Portions of the constructive occlusion light emissions, that otherwise would travel out toward the horizon, impact on the perpendicular reflector sections 117' and 118'. If these sections are specular, the perpendicular reflector sections 117'and 118' reflect this light upward at low angles to provide an additional component of illumination above the system 111' (in the illustrated orientation).

Figure 6:
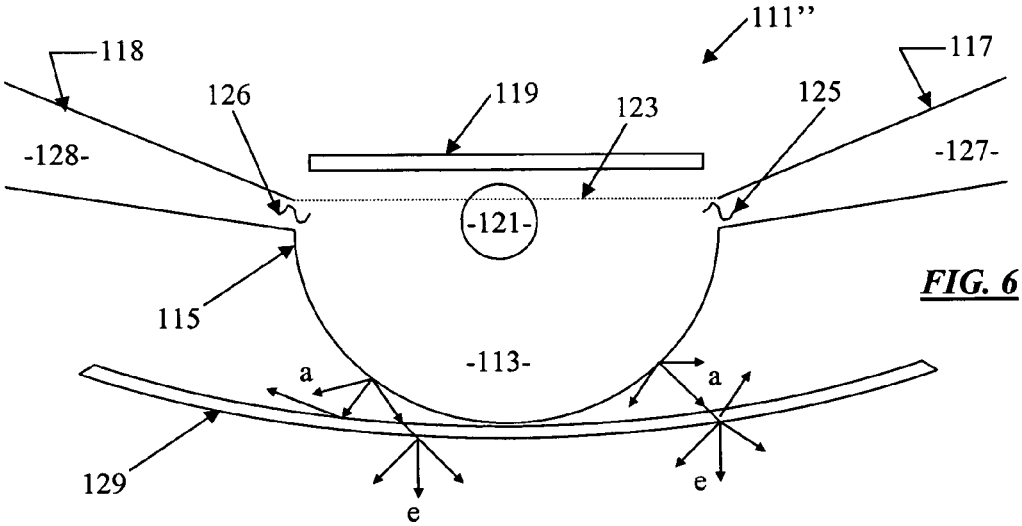
FIG. 6 is a cross-sectional view of a lighting system similar to that of FIGS. 3 and 4 but with a second diffuser for additional processing of the transmissive illumination component.

FIG. 6 shows another example 111" of a lighting system. The system 111" is essentially similar to the system 111 of FIGS. 3 and 4, and like elements are indicated by the same reference numerals. In general, system operation is similar to that described above relative to FIGS. 3 and 4.

As noted in the discussion of FIGS. 3 and 4, for purposes of direct lighting of the first field of illumination, the wall 115 of cavity 113 functions as a first diffuser. The system 111" of FIG. 5 includes a partially transmissive partially reflective type of baffle, which in the example, comprises a second diffuser 129. The second diffuser 129 may actually be a substrate on which a white coating forms the wall 115, or it may be a separate component as shown. In some examples, the material of the second diffuser adds strength or rigidity to the cavity wall 115. However, the material and configuration of the diffuser 129 may be chosen to provide an additional distribution or control function with regard to dispersal of the light rays a over the first field that is being illuminated by the system 111".

In the example, the second diffuser 129 is a partially transmissive and partially reflective baffle structure. The diffuser 129, for example, may be formed of a sheet of a translucent substantially white material, such as glass or plastic. Those skilled in the art will recognize that the diffuser 29 may be formed of other materials or structures or that other partially transmissive processing elements may be used as the baffle. The second diffuser 129 is positioned outside the cavity wall 115 so as to reflect a part of the light rays a back to the cavity 113 and to pass and diffuse another part of the light rays, as further diffused rays e over the first field of illumination.

Figure 7:
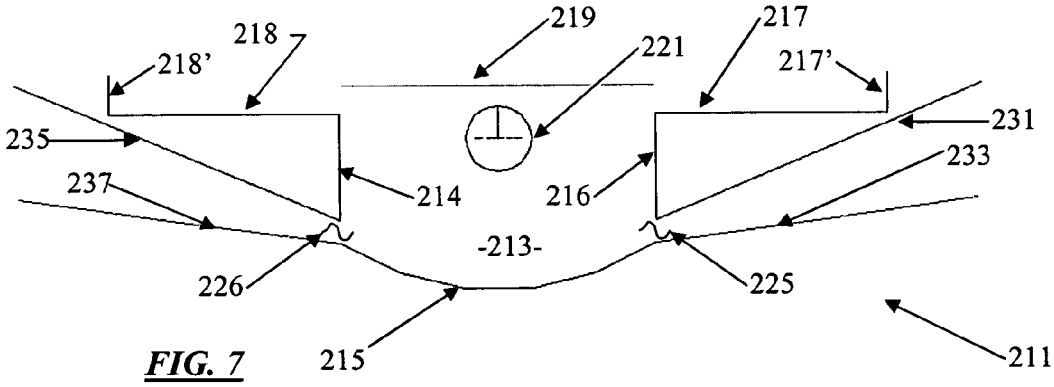
Figure 8:
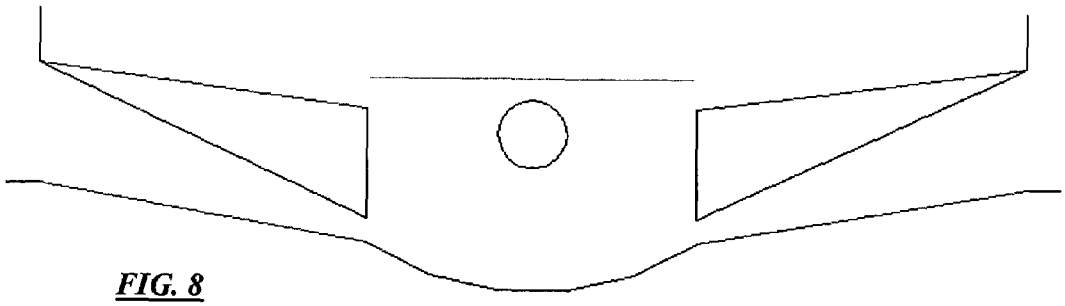
Figure 9:
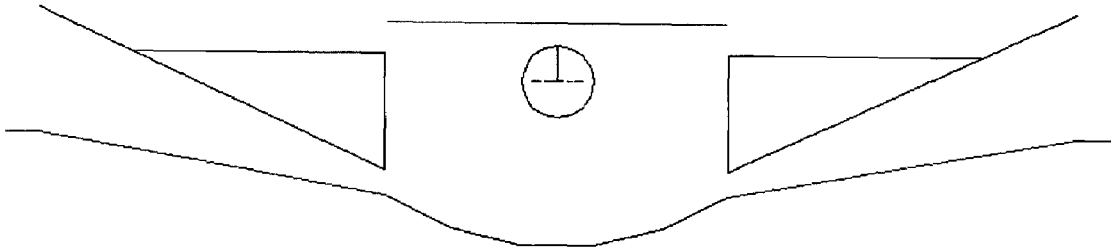
Figure 10:
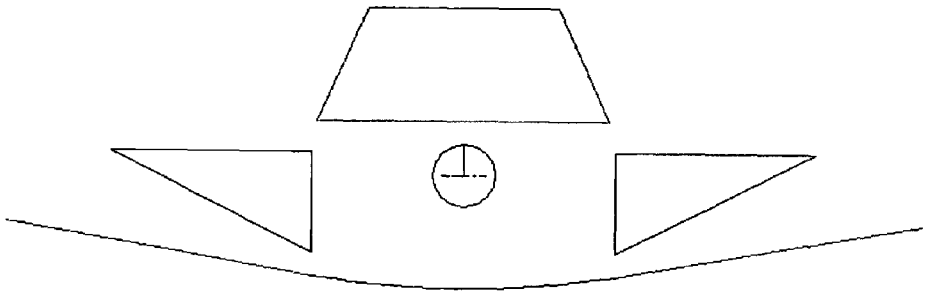
Figure 14:
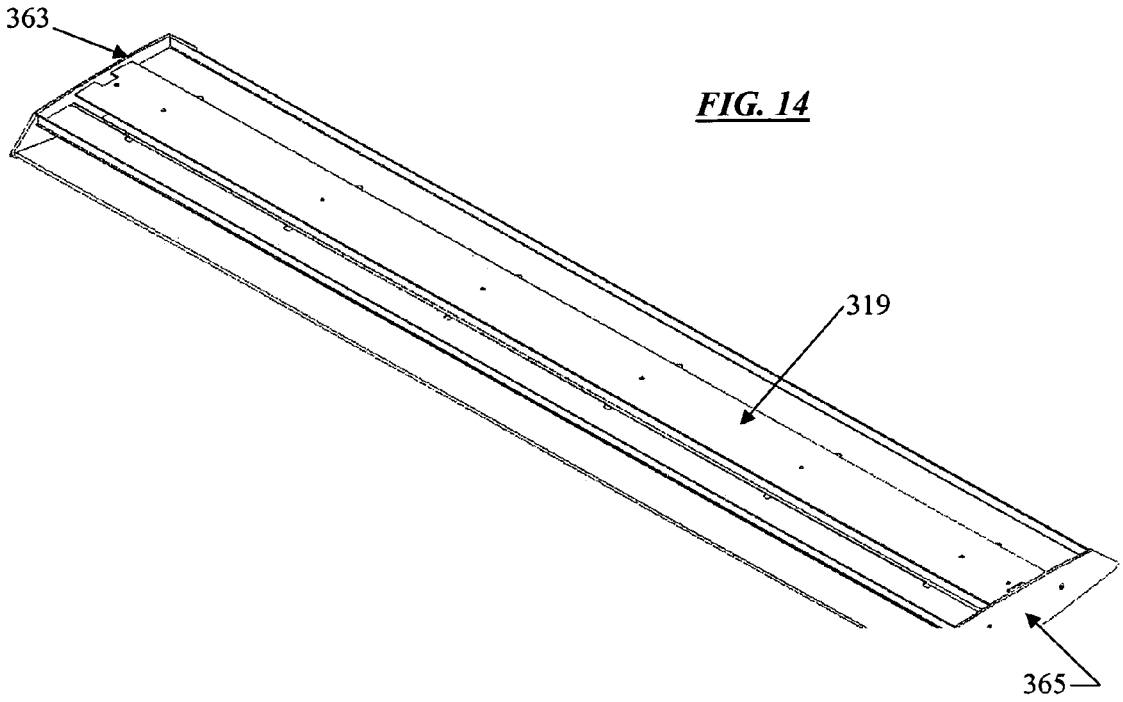
Figure 15:
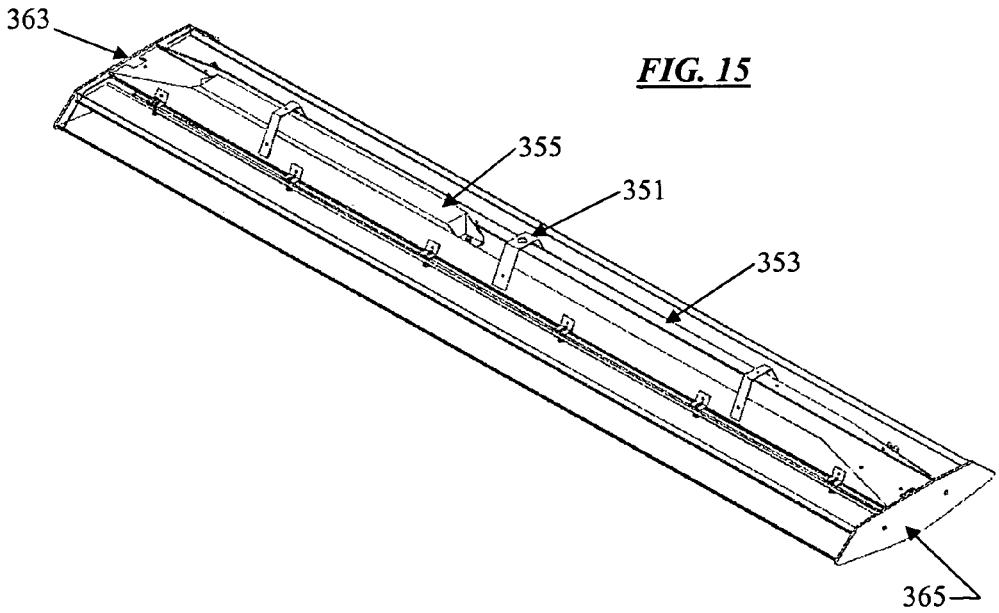

FIG. 7 is a cross-sectional view, showing the first of several further modifications of the lighting system. This modified system 211 is generally similar to those of FIGS. 3 to 5, but the lateral ports have been moved (downward in the illustrated orientation), and the cross-sectional shape of the cavity has been changed somewhat.

Like the earlier examples, the system 211 is optimized for providing an up-light illumination, albeit with additional components radiated out in areas nearing the horizon to the right and left sides of the system. The various up-light components, for example, may reflect off a supporting ceiling or wall for indirect illumination of a room or the like. The system also provides a transmissive component. Although the system 211 may be oriented in other directions, in the illustrated orientation, the constructive occlusion component and the additional components are generally directed upward to illuminate a relatively wide second field, for example, across a ceiling or wall where the system 211 is used for an indirect lighting application. In this orientation, the system would emit the transmissive component downward toward a first field.

The system 211 takes the form of a fluorescent light fixture. As in the earlier embodiments, the system 211 comprises a base having a diffusely reflective cavity 213 having an outer wall. However, in this embodiment, the cavity wall comprises several components. As shown, the wall comprises a first sidewall 214 shown to the left, a bottom diffuser portion 215 and a second sidewall 216 shown to the right.

The surfaces of the wall of the cavity 213, that is to say the surfaces of the sidewalls 214 and 216 and the surface of the diffuser wall 215 all exhibit a diffuse reflectivity, as did the cavity walls in the examples discussed above. The sidewalls 214 and 216 are formed of diffuse reflectors similar to the reflector formed on the facing surface of the mask 23 or 119 in the earlier examples. Practical embodiments would typically include a wall or end cap across one or most often across both ends of the system 211. The inward facing surfaces of such end caps typically are formed of similar materials, to provide diffuse reflectivity within the cavity 213.

The system 211 exhibits a relatively wide rectangular aperture across the cavity opening formed by the upper edges of the sidewalls 214 and 216. Again, the aperture forms the active optical area of the base, for purposes of constructive occlusion by the mask 219. The structures forming the sidewalls 214 and 216 also form shoulders 217 and 218 along the sides of the aperture. Each shoulder 217, 218 includes a perpendicular reflector section 217', 218'. The upper edges of these reflector sections 217' and 218' limit the range of light emission from the mask and cavity type constructive occlusion illumination.

In this embodiment, ports 225, 226 are formed relatively deep along the wall of the cavity, specifically, as gaps between the lower edges of the sidewalls 214 and 216 and the lower diffuser wall 215.

In this example, the source 221 is an elongated tubular source, such as a fluorescent lighting tube. The ballast, the housing for the ballast and the structure for mounting or supporting the system 211 are omitted, for ease of illustration.

The mask 219 constructively occludes light diffused within the cavity 213 from the source 221 and passing through the cavity aperture formed between the top edges of the sidewalls 214 and 216. The mask 219 has a diffusely reflective surface facing toward the aperture.

In addition to a substantial reflectivity, the lower diffuser wall 215 is partially transmissive. The wall 215 passes and diffuses a first portion of the electromagnetic radiation, in the example, from the source light source 221, over a first field of illumination, which is downward in the illustrated orientation. If viewed from the first field, the wall 215 appears as a light diffuser. As in the earlier examples, the wall 215 has a diffusely reflective inner surface. This inner surface of wall 215 and the sidewalls 214, 216 diffusely reflect a second portion of the electromagnetic radiation from the source 221 within the cavity 213. However, again, the reflective surface of the wall 215 is not a perfect reflector and is partially transmissive as well. Although most of the energy may be reflected, some passes into and through the wall 215. In this manner, a substantial portion of the non-reflective light passes through the wall 215 toward the first field to be illuminated. The materials for forming the wall 215 may be the same as used for the wall 115 in the examples of FIGS. 3 to 6.

The second field to be illuminated is vertically above the system 211 in the orientation illustrated in FIG. 7 and is substantially centered about the vertical axis (180°). In this system 211, there are actually two shoulders 217, 218. The shoulders extend along the longer sides of the rectangular cavity near the sides of the aperture. Essentially, each shoulder is constructed as a flat reflective plate mounted at the desired angle with respect to the plane of the aperture. In this example, the shoulders 218, 218 are substantially coplanar with the aperture. The upper surface of each shoulder, facing a portion of the field to be illuminated by constructive occlusion, has a light reflective characteristic. In the preferred form of this embodiment, the surface of each of the two shoulders 217, 218 is specular, although a diffuse reflectivity or other reflective characteristic (or combinations thereof) could be used on the shoulders.

As noted above, the up-light system 211 of FIG. 7 includes two ports 225, 226 providing rectangular openings into the opposing sides of the cavity 213. The system includes a deflector structure coupled to the port 225 and a deflector structure coupled to the port 226. In this example, the structure supporting the cavity sidewall 216 extends outward to form a first or upper plate 231 of the deflector structure coupled to the port 225, and the structure forming or supporting the diffuser wall 215 forms a second or lower plate 233 of the deflector structure coupled to the port 225. Similarly, the structure supporting the cavity sidewall 214 extends outward to form a first or upper plate 235 of the deflector structure coupled to the port 226, and the structure forming or supporting the diffuser wall 215 forms a second or lower plate 237 of the deflector structure coupled to the port 226.

The interior surfaces of the plates 231 to 237 forming the two fan-shaped deflector structures are substantially specular, although materials of other types of reflectivity could be used for certain applications. The port 225 and the associated deflector plates 231, 233 direct light from the cavity 213 toward the horizon on one side of the system (to the right in the drawings). Similarly, the port 226 and the deflector structure plates 235, 237 direct light from the cavity 213 toward the horizon on the other side of the system (to the left in the drawings).

The light source 221 is a fluorescent lamp, that is to say in the form of an elongated tube. In this example, the light source preferably is linear and extends along a substantial portion of the cavity, but other light sources could be used. For example, a remote lamp could transmit light to specific points along the cavity wall through a series of optical fibers coupled to openings through the base into the cavity or through similar openings in the mask. Another approach might be to use a number of LEDs emitting light from points on the mask and/or the wall(s) of the cavity 213. The source 221 could be positioned virtually anywhere so that its light passes into the space between the mask and cavity.

With respect to the mask 219, the cavity aperture appears to be a planar Lambertian diffusion surface or source. With respect to each port and fan-shaped deflector structure, the combination of the mask 219 and the cavity 213 forms an integrating cavity for efficiently coupling light from the source 221 through the respective port 225 or 226.

The port and fan-shaped deflector structures provide relatively high-intensity illumination out toward the horizon of the system 211. The constructive occlusion provides a lower intensity illumination of the second field, e.g. directly above the system in the illustrated orientation. The constructive occlusion illumination extends outwards towards the horizon. Although the constructive occlusion illumination may overlap the areas illuminated through the ports 226, 225 and associated deflectors, the side reflectors 217', 218' limit or prevent substantial overlap.

The light components provided by the constructive occlusion and the emissions through the ports/deflectors typically are used for indirect lighting, e.g. by reflection (downward in the illustration) from a ceiling or wall. In the illustrated orientation, the system 211 provides illumination downward (0°), by virtue of the diffuse illumination transmitted from the cavity 213 through the partially transmissive diffuser wall 215.

The system 211 may be used as a "troffer" type indirect lighting system, with a fluorescent lamp source, hanging down from but aimed up toward a ceiling. The indirect illumination of an area by such a lighting system 211 relies on light bouncing down off of the ceiling. In the example, the indirect lighting is combined with the diffuse illumination by the rays passing through and diffused by the diffuser wall 215 (toward the first field of illumination).

FIGS. 8 to 11 show various examples similar to the system 211 of FIG. 7, but using slightly different shapes for the system elements so as to provide different performance characteristics.

FIGS. 12 to 16 are various views of a prototype lighting system 311 providing both a transmissive component and illumination by constructive occlusion, and showing the addition of a second diffuser for additional processing of the transmissive illumination component. FIG. 12 is a cross-sectional view of the system; and FIG. 13 is a similar view but with several housing and support elements removed to simplify the illustration of the optical light processing components of the system 311.

This example is an indirect lighting system 311, comprising a light source 321 and an optical cavity 313 for receiving and processing light from the source. The light source in the example is a tubular source, such as a fluorescent light, although other sources may be used as in the earlier examples. The optical cavity 313 has a wall, in this case formed by a first (left) sidewall 314, a lower diffuser wall 315 and a second (right) sidewall 316. The transmissive diffuser section 315 of the cavity wall passes and diffuses a first portion of the light from the source 321 over a first field of illumination, downward in the illustrated orientation. The cavity wall formed by surfaces 314, 315 and 316 exhibits a diffusely reflective characteristic, so that it diffusely reflects some of the light from the source 321 within the cavity 313.

In this example, the system 321 includes a diffuser 329 type baffle, positioned outside the cavity wall, as an additional partially transmissive/partially reflective light processing element. The diffuser 329 extends substantially from one side of the system to the other (see FIGS. 12 and 13). As shown, the lower diffuser wall 315 is formed or rests on the inner (upper) surface of the diffuser 329. The second diffuser 329 may actually be a substrate on which a white coating forms the wall 315. In the example, the wall 315 comprises a sheet of appropriate reflective and transmissive material, and the diffuser 329 is a separate component on which the sheet forming wall 315 rests. Hence, the material of the second diffuser 329 adds strength or rigidity to the cavity wall 315. Furthermore, in this example, the material and configuration of the second diffuser 329 provide an additional distribution or control function with regard to dispersal of the light rays over the first field that is being illuminated (downward in the illustrated orientation).

In the region under the cavity wall 315, the second diffuser 329 reflects a part of the light passing through wall 315 back to the cavity 313. However, this portion of the diffuser 329 also is transmissive, and therefore it passes and diffuses another part of the light coming through the wall 315. The light transmitted through this part of the diffuser 329 provides illumination over the first field of illumination, downward in the illustrated orientation.

The upper edges of the sidewalls 314, 316 form an aperture of the optical cavity 313, facing toward a second field of illumination (upward in the illustrated orieintation). The system also includes a mask 319 spaced from the aperture and having a reflective surface 319' facing toward the aperture. As in the earlier examples, the mask 319 is positioned relative to the aperture so as to occlude a substantial part of the aperture and to thereby provide a tailored distribution of light emerging from between the mask and aperture, over a second field of illumination (upward in the illustrated orientation).

One or more supports 351 are provided, for attaching the lighting system 311 in relation to a face structure, like a wall or ceiling. For example, the supports 351 (FIG. 15) typically allow system mounting so that the diffused first portion of the light (through the diffusers 315 and 329) provides direct illumination in the first field. Another portion of the light, processed by constructive occlusion illuminates the second field onto the face structure for reflection and indirect illumination. Cavity ports and deflectors are also provided to throw further light out near the edges of the region illuminated by constructive occlusion.

The system 311 takes the form of a fluorescent light fixture. In this example, the source 321 is an elongated tubular source, such as a fluorescent lighting tube. The system 311 also includes a housing 353 supporting the mask 319. The housing 353 contains the ballast 355 for the fluorescent lighting tube, and the housing provides an attachment for the mounting or supporting brackets 351.

The housing 353 includes flanges for attachment of bolts 357. The diffuser 329 is hung from the lower ends of the bolts 357. The bolts 357 also support lateral support structures 359 and 361, for example, made of metal. On the sides facing the cavity 313, each lateral structure 359, 361 supports the material forming the respective reflective sidewall 314 or 316, e.g. a coating or panel formed of a diffusely reflective material. The structures 359, 361 also form shoulders 317, 318 with side reflectors 317', 318'as well as the reflective upper panels 331, 335 of two deflectors. Reflective panels 333 and 337 are supported by the diffuser 329, on either side of the diffuser wall material 315. The system 311 also includes walls or end caps 363, 365 attached at the ends of the system. At least the inner surfaces of the end caps 363, 365 are diffusely reflective, as they form end walls of the cavity 313.

The system 311 exhibits a relatively wide rectangular aperture across the cavity opening formed by the upper edges of the sidewalls 314 and 316. Again, the aperture forms the active optical area of the base, for purposes of constructive occlusion by the mask 319. As noted, the support structures forming the sidewalls 314 and 316 also form shoulders 317 and 318 along the sides of the aperture. Each shoulder 317, 318 includes a perpendicular reflector section 317', 318'. The upper edges of these reflector sections 317' and 318' limit the range of light emission from the mask and cavity type constructive occlusion illumination.

In this embodiment, the ports 325, 326 are formed relatively deep along the wall of the cavity 313, specifically, as gaps between the lower edges of the sidewalls 314 and 316 and the lower diffuser wall 315.

The mask 319 constructively occludes light diffused within the cavity 313 from the source 321 and passing through the cavity aperture formed between the top edges of the sidewalls 314 and 316. The mask 319 has a diffusely reflective surface 319' facing toward the aperture.

In addition to a substantial reflectivity, the lower diffuser wall 315 also is partially transmissive. The wall 315 passes and diffuses a first portion of the electromagnetic radiation, in the example, from the source light source 321, over a first field of illumination, which is downward in the illustrated orientation. If viewed from the first field, the wall 315 appears as a light diffuser. As in the earlier examples, the wall 315 has a diffusely reflective inner surface. This inner surface of the wall 315 and the sidewalls 314, 316 diffusely reflect a second portion of the electromagnetic radiation from the source 321 within the cavity 313. However, again, the reflective surface of the wall 315 is not a perfect reflector and is partially transmissive as well. Although most of the energy may be reflected, some passes into and through the wall 315. In this manner, a substantial portion of the non-reflective light passes through the wall 315 toward the first field to be illuminated.

The second field to be illuminated is vertically above the system 311 in the orientation illustrated in FIGS. 12 and 13 and is substantially centered about the vertical axis (180°). In this system 311, there are actually two shoulders 317, 318. The shoulders extend along the longer sides of the rectangular cavity near the sides of the aperture. Essentially, each shoulder is constructed as a flat reflective plate mounted at the desired angle with respect to the plane of the aperture. In this example, the shoulders 318, 318 are substantially coplanar with the aperture. The upper surface of each shoulder, facing a portion of the field to be illuminated by constructive occlusion, has a light reflective characteristic. In the preferred form of this embodiment, the surface of each of the two shoulders 317, 318 is specular, although a diffuse reflectivity or other reflective characteristic (or combinations thereof) could be used on the shoulders.

As noted above, the up-light system 311 includes two ports 325, 326 providing rectangular openings into the opposing sides of the cavity 313. The system includes a deflector structure coupled to the port 325 and a deflector structure coupled to the port 326. In this example, the structure 361 supporting the cavity sidewall 316 extends outward to form a first or upper plate 331 of the deflector structure coupled to the port 325, and the diffuser 329 supports a second or lower plate 333 of the deflector structure coupled to the port 325. Similarly, the structure 359 supporting the cavity sidewall 314 extends outward to form a first or upper plate 335 of the deflector structure coupled to the port 326, and the diffuser 329 supports a second or lower plate 337 of the deflector structure coupled to the port 326.

The interior surfaces of the plates 331 to 337 forming the two fan-shaped deflector structures are substantially specular, in this example. The port 325 and the associated deflector plates 331, 333 direct light from the cavity 313 toward the horizon on one side of the system (to the right in the drawings). Similarly, the port 326 and the deflector structure plates 335, 337 direct light from the cavity 313 toward the horizon on the other side of the system (to the left in the drawings).

With respect to the mask 319, the cavity aperture appears to be a planar Lambertian diffusion surface or source. With respect to each port and fan-shaped deflector structure, the combination of the mask 319 and the cavity 313 forms an integrating cavity for efficiently coupling light from the source 321 through the respective port 325 or 326. The port and fan structures provide relatively high-intensity illumination out toward the horizon of the system 311. The constructive occlusion provides a lower intensity illumination of the second field, e.g. directly above the system in the illustrated orientation.

The light components provided by the constructive occlusion and by the emissions through the ports/deflectors typically are used for indirect lighting, e.g. by reflection (downward in the illustration) from a ceiling or wall. In the illustrated orientation, the system 311 provides illumination downward (0°), by virtue of the diffuse illumination transmitted from the cavity 313 through the partially transmissive diffuser wall 315.

The system 311 may be used as a "trougher" type indirect lighting system, with a fluorescent lamp source, hanging down from but aimed up toward a ceiling. The indirect illumination of an area by such a lighting system 311 relies on light bouncing down off of the ceiling. The constructive occlusion parameters and the arrangement of the ports and deflectors provide relatively uniform illumination over a wide area of the ceiling, for reflection down into the room or area below. In the example, the indirect lighting is combined with the diffuse illumination by the rays passing through and diffused by the cavity wall 315 and second diffuser 329 (toward the first field of illumination).

Figure 16:
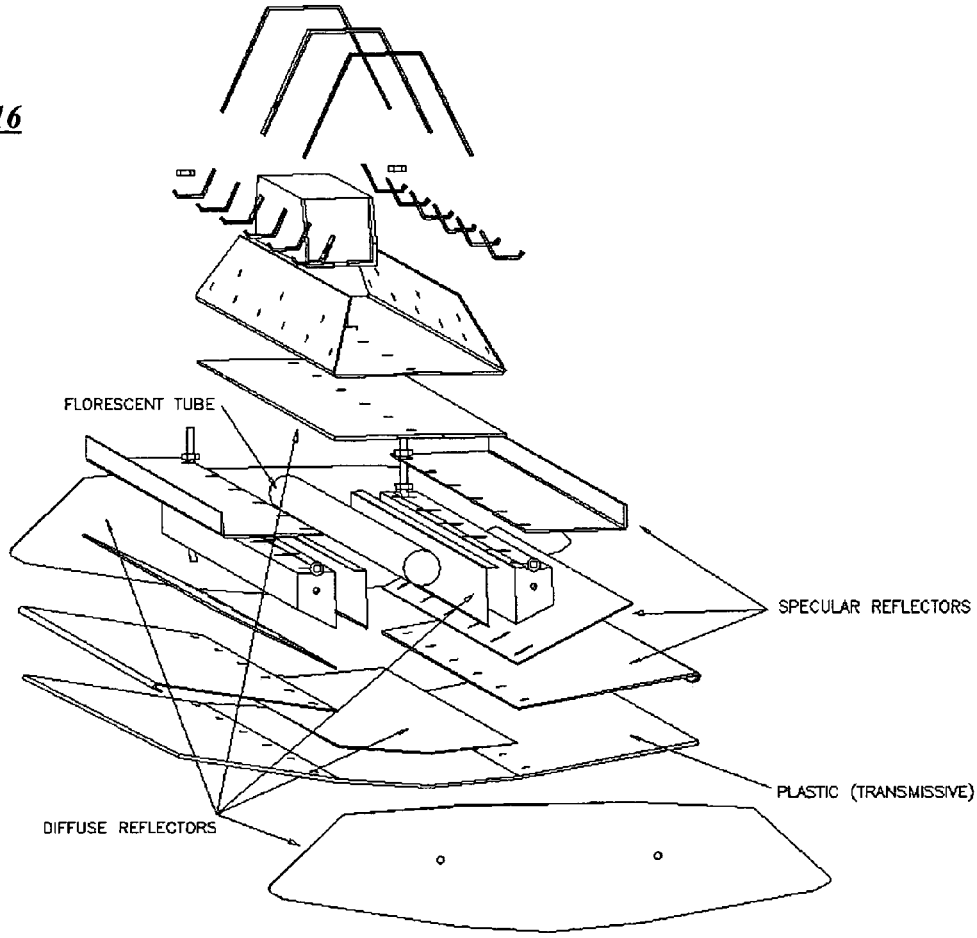

FIG. 16 is a shortened exploded view of the system 311, wherein the materials forming the various reflective surfaces and the second diffuser are labeled by type. The illustrated system may utilize a variety of optical materials. For example, the diffuse reflectors may be formed of Tyvek™, Gore Whitestar™, AOT White 96™ paint, Ferro Plastic of the types npp00rs01wh, npp00rt5677wh, or npp00rt5678wh, or other similar materials. Depending on the precise material used for any diffuse reflector, the material may be supported on a rigid substrate. The specular reflectors may be formed of Alanod Mirro 2, 3M Vikuiti™ Enhanced Specular Reflector Film or the like. Where the reflective materials are formed as a layer or otherwise supported on a substrate, the substrate material may be any convenient material that is sufficiently rigid and strong, such as a rigid plastic or a metal like steel or aluminum. The second diffuser 329 may be a diffusely transmissive glass or plastic material, of a white or off-white color.

Those skilled in the art should recognize that the implementations of the lighting systems shown and described above are by way of examples, only. A wide range of variations and applications are possible. For example, if an application warrants, the mask may be partially transmissive in a manner similar to the portion of the cavity wall that passes and diffuses light towards the first field of illumination. If the mask is similarly constructed to pass and diffuse some portion of light toward the second field of illumination, the mask may be provided with a secondary diffuser, similar to those provided in association with the exterior of the cavity wall in several of the examples.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. An indirect lighting system, comprising:

a light source;

an optical cavity for receiving light from the source and having a wall, wherein at least a section of the cavity wall exhibits both a transmissive characteristic and at least a partially diffusely reflective characteristic, wherein the transmissive characteristic enables the section of the cavity wall to pass a first portion of the light from the source through the section of the cavity wall toward a first field of illumination, and the at least partially diffusely reflective characteristic enables the section of the cavity wall to diffusely reflect some of the light from the source within the cavity;

a baffle that is at least partially transmissive, positioned outside the cavity and between the section of the cavity wall and the first field of illumination, for passing at least some of the first portion of the light through to the first field of illumination;

an aperture of the optical cavity, facing toward a second field of illumination;

a mask outside the cavity spaced from the aperture and having a reflective surface facing toward the aperture, wherein the mask is positioned relative to the aperture so as to occlude a substantial part of the aperture and to thereby provide a tailored distribution of a second portion of the light emerging from between the mask and aperture over the second field of illumination; and a support, for attaching the lighting system in relation to a face structure in such a manner that the diffused first portion of the light provides direct illumination in the first field, and the second portion of the light illuminates the second field onto the face structure for reflection and indirect illumination of the first field with reflected light from the second portion.

2. The system as in claim 1, wherein the source and cavity are arranged to provide emission of a third portion of the light from the source over a third field of illumination.

3. The system as in claim 2, wherein the arrangement of the source and cavity includes a port through the cavity wall, for emitting the third portion of the light from the source toward the third field of illumination.

4. The system as in claim 3, further comprising a deflector coupled to the port and having a reflective surface expanding outward as the deflector extends from the port toward the third field of illumination, for directing the third portion of light from the source over the third field of illumination.

5. The system as in claim 1, further comprising a reflective shoulder along at least a portion of a perimeter of the aperture.

6. The system as in claim 1, wherein the support is adapted to mount the lighting system on a wall or ceiling of a space to be illuminated by the system.

7. The system of claim 1, wherein the section of the cavity wall comprises a diffusely reflective material providing at least 85% reflectivity of the light from the source back within the cavity.

8. The system as in claim 7, wherein the section of the cavity wall is substantially white and exhibits a reflectivity of approximately 96% with respect to the light from the source.

9. The system of claim 7, wherein the reflective surface of the mask comprises a diffusely reflective material providing at least 85% reflectivity of the light from the source back within the cavity.

10. The system as in claim 9, wherein:

the section of the cavity wall is substantially white and exhibits a reflectivity of approximately 96% with respect to the light from the source; and the reflective surface of the mask is substantially white and exhibits a reflectivity of approximately 96% with respect to the light from the source.

11. The system of claim 1, wherein the baffle is also at least partially reflective, so as to reflect some of the first portion of the light back toward the section of the cavity wall.

12. The system of claim 11, wherein the baffle comprises a substantially white diffuser.

13. The system of claim 12, wherein the diffuser comprises a translucent plastic material.

14. An indirect lighting system, comprising:

a light source;

an optical cavity for receiving light from the source and having a wall, wherein at least a section of the cavity wall exhibits both a transmissive characteristic and at least a partially diffusely reflective characteristic, wherein the transmissive characteristic enables the section of the cavity wall to pass a first portion of the light from the source through the section of the cavity wall toward a first field of illumination, and the at least partially diffusely reflective characteristic enables the section of the cavity wall to diffusely reflect some of the light from the source within the cavity, the cavity wall comprising a substantially white material providing at least 85% reflectivity of light from the source;

a partially transmissive baffle located outside the cavity and between the section of the cavity wall and the first field of illumination for processing and passing at least some of the first portion of the light to the first field of illumination;

an aperture of the optical cavity, facing toward a second field of illumination;

a mask outside the cavity spaced from the aperture and having a reflective surface facing toward the aperture, wherein the mask is positioned relative to the aperture so as to occlude a substantial part of the aperture and to thereby provide a tailored distribution of a second portion of the light emerging from between the mask and aperture over the second field of illumination;

a support, for attaching the lighting system in relation to a face structure in such a manner that the diffused first portion of the light provides direct illumination in the first field, and the second portion of the light illuminates the second field onto the face structure for reflection and indirect illumination of the first field with reflected light from the second portion; and means for providing emission of a third portion of the light from the source over a third field of illumination.

15. The system as in claim 14, wherein the partially transmissive baffle comprises a diffuser, for diffusing light over the first field of illumination.

16. The system as in claim 14, wherein the means comprises a port for allowing emission of light from the cavity toward the third field of illumination.

17. The system as in claim 16, wherein the means further comprises a light deflector having a reflective surface coupled to the port.

18. The system as in claim 14, wherein the section of the cavity wall is substantially white and exhibits a reflectivity of approximately 96% with respect to the light from the source.

19. The system of claim 14, wherein the reflective surface of the mask comprises a diffusely reflective material providing at least 85% reflectivity of the light from the source back within the cavity.

20. The system as in claim 19, wherein:

the section of the cavity wall exhibits a reflectivity of approximately 96% with respect to the light from the source; and the reflective surface of the mask is substantially white and exhibits a reflectivity of approximately 96% with respect to the light from the source.

* * * * *